US006880347B1

(12) United States Patent
Stam

(10) Patent No.: US 6,880,347 B1
(45) Date of Patent: Apr. 19, 2005

(54) UPPER ARM PROTECTION SHOULDER PAD ACCESSORY

(76) Inventor: Douglas M. Stam, 436 Jeremy Dr., Bourbonnais, IL (US) 60914

( * ) Notice: Subject to any disclaimer, the term of this patent is extended or adjusted under 35 U.S.C. 154(b) by 0 days.

(21) Appl. No.: 10/604,804

(22) Filed: Aug. 18, 2003

Related U.S. Application Data

(60) Provisional application No. 60/411,173, filed on Sep. 17, 2002.

(51) Int. Cl.[7] ..... A61F 5/00

(52) U.S. Cl. ..... 62/20; 602/62; 128/878; 2/459; 2/16

(58) Field of Search ..... 602/20, 21, 62, 602/63, 64; 128/878; 2/459, 460, 16, 20, 2/908, 910

(56) References Cited

U.S. PATENT DOCUMENTS

| | | | | |
|---|---|---|---|---|
| 2,663,295 | A * | 12/1953 | Lewandowski et al. | 128/881 |
| 4,467,475 | A * | 8/1984 | Gregory et al. | 2/462 |
| 4,590,622 | A * | 5/1986 | Wolfe et al. | 2/462 |
| 4,654,893 | A * | 4/1987 | Meyers et al. | 2/462 |
| 4,698,845 | A | 10/1987 | Cosby | 2/462 |
| 4,982,447 | A * | 1/1991 | Henson | 2/462 |
| 4,982,745 | A * | 1/1991 | Shields | 128/877 |
| 5,020,521 | A * | 6/1991 | Salort | 602/20 |
| 5,023,953 | A * | 6/1991 | Bettcher | 2/126 |
| 5,029,341 | A | 7/1991 | Wingo, Jr. | 2/462 |
| 5,065,457 | A * | 11/1991 | Henson | 2/16 |
| 5,188,587 | A * | 2/1993 | McGuire et al. | 602/20 |
| 5,237,704 | A | 8/1993 | Phippen | 2/45 |
| 5,398,339 | A | 3/1995 | Wagner | 2/462 |
| 5,403,268 | A * | 4/1995 | Clement | 602/20 |
| 5,638,546 | A * | 6/1997 | Vita | 2/16 |
| 5,647,062 | A | 7/1997 | Nigbur | 2/16 |
| 5,911,197 | A * | 6/1999 | Schmid | 119/712 |
| 6,076,185 | A | 6/2000 | Schramm | 2/16 |
| 6,094,743 | A * | 8/2000 | Delgado | 2/16 |
| 6,192,519 | B1 | 2/2001 | Coalter | 2/16 |
| 6,205,583 | B1 | 3/2001 | Beland | 2/16 |
| 6,342,043 | B1 * | 1/2002 | Gottsmann et al. | 602/12 |

OTHER PUBLICATIONS

CHAMPRO Accessory Pads: GABP Auxiliary Bicep Pads (Web Pages).

* cited by examiner

*Primary Examiner*—Henry Bennett
*Assistant Examiner*—Amanda Wieker
(74) *Attorney, Agent, or Firm*—Reginald F. Roberts, Jr.

(57) ABSTRACT

A shoulder pad accessory arm pad, to protect the upper arm of a wearer from injury. The arm pad includes a tapered padded member which attaches to the shoulder pad and arm of the wearer. The arm pad remains in place during athletic activity, and does not limit the effective range of motion of the upper arm of the wearer.

1 Claim, 4 Drawing Sheets

UPPER ARM PROTECTION SHOULDER PAD ACCESSORY

CROSS REFERENCE TO RELATED APPLICATIONS

This application is a Nonprovisional Application for the subject matter disclosed by my Provisional Application 60/411,173, filed Sep. 17, 2002.

BACKGROUND OF INVENTION

The present invention relates to orthopedics. More particularly, the invention relates to an orthopedic device which protects the wearer from injury while participating in an athletic event.

Contact sports like football involve varying degrees of intentional contact between players, and thus often require protective pads to be positioned and located on various parts of the body to protect the player from such contact. In football, players typically wear shoulder pads and hip pads, and the like, positioned under the uniform. More recently, football players wear elbow pads, forearm pads, and even hand pads. However there is a paucity of protective padding for the arm (humerus) of football players. Typical arm pads are constructed of a tubular member, which is formed from an elastic material, and one or more pads, which are either positioned in a sleeve provided in the tubular member or attached to the outer surface of the tubular member. The arm pad, therefore, includes a padded portion which is somewhat inflexible due to the pad, and an elastic portion which stretches to permit the wearer of the pad to put the pad on the arm and to permit the wearer to a limited degree to bend his arms. Pads that are used to protect the humerus typically either (a) do not stay in place without taping, or (2) bump into the shoulder pad when the user raises his arm above the shoulder, thus limiting the range of motion. When worn on the player's arm, the padded portion is positioned outwardly with the elastic portion facing inward toward the user's body. Because pads for the upper arm do not stay in place or because they limit the range of motion, they are not often used. When a player carries the ball, his arm (humerus) is exposed and vulnerable to contact. Although padding for the upper arm is highly desirable to protect the player, especially younger players, from blows which are normally associated with contact sports, players often forego wearing such protective gear because the padding for the upper arm does not stay in place and needs to be taped for each practice session or game, or because the pad blocks the full range of motion of the arm; or, if they do use protective pads, they are easily misplaced, especially by younger players. Consequently, there is a need for a protective sports pad which permits the wearer to quickly position and remove the pad, does not limit the range of arm motion, stays in place until it is no longer needed, and is not easily misplaced or lost. The present invention provides such a protective pad.

SUMMARY OF INVENTION

In general, the present invention provides a shoulder pad accessory arm pad, to protect an upper arm of a wearer from injury. The arm pad comprises (a) an elongated padded member defining first and second opposite ends, the padded member being constructed and arranged for disposal therein of the arm of the wearer, to protect the arm from injury; (b) means for attaching the first end of the padded member to a shoulder pad of the wearer, to secure the first end of the padded member to the shoulder of the wearer; and (c) means for attaching the second end of the padded member to the arm of the wearer, to secure the padded member to the arm of the wearer.

DETAILED DESCRIPTION

The present invention provides a sports pad. More particularly, the invention provides an upper-arm pad which can be attached to and detached from the shoulder pads worn by football players.

Figure 1A:
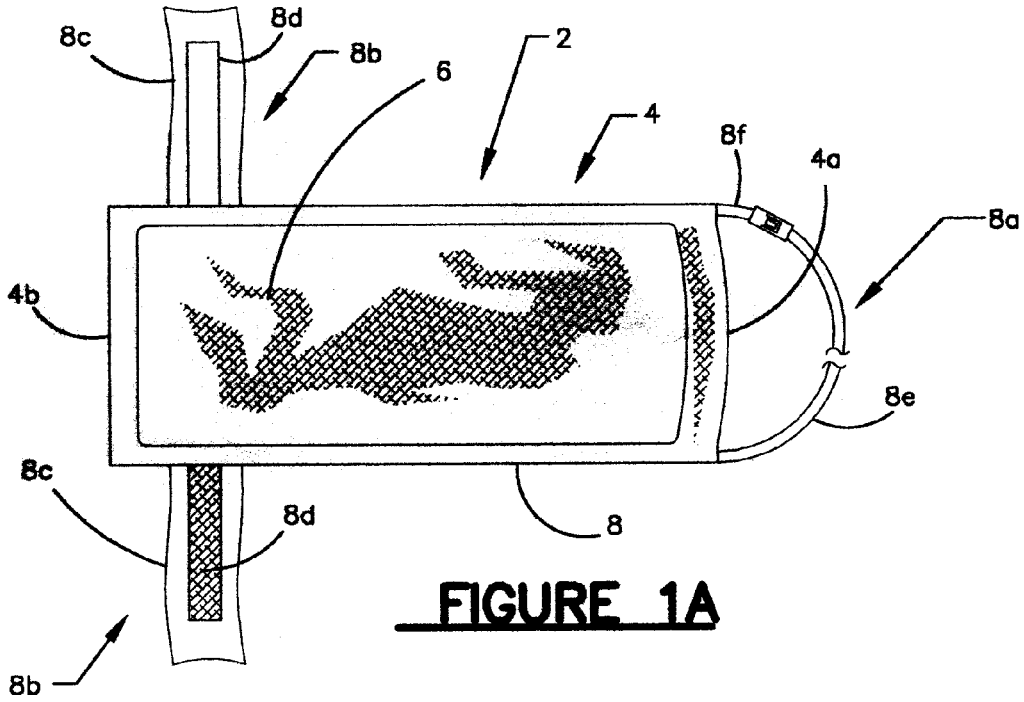
FIG. 1A is a plan view, from below, of a shoulder-pad accessory for upper-arm protection, made in accordance with the principles of the present invention.
Figure 1B:
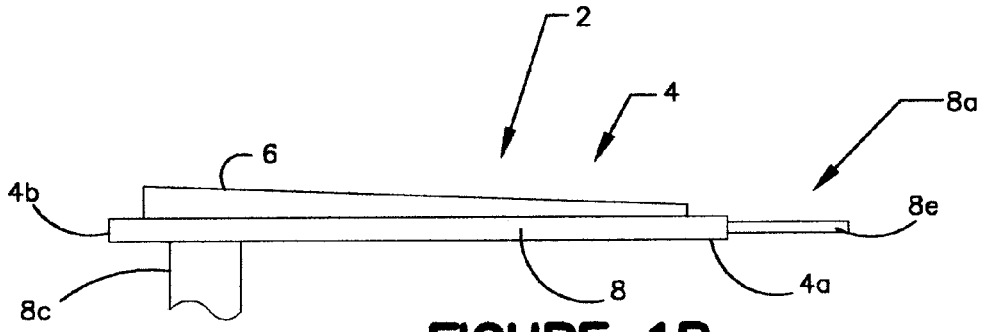
FIG. 1B is a side view of the shoulder-pad accessory shown in FIG. 1A.
Figure 2:
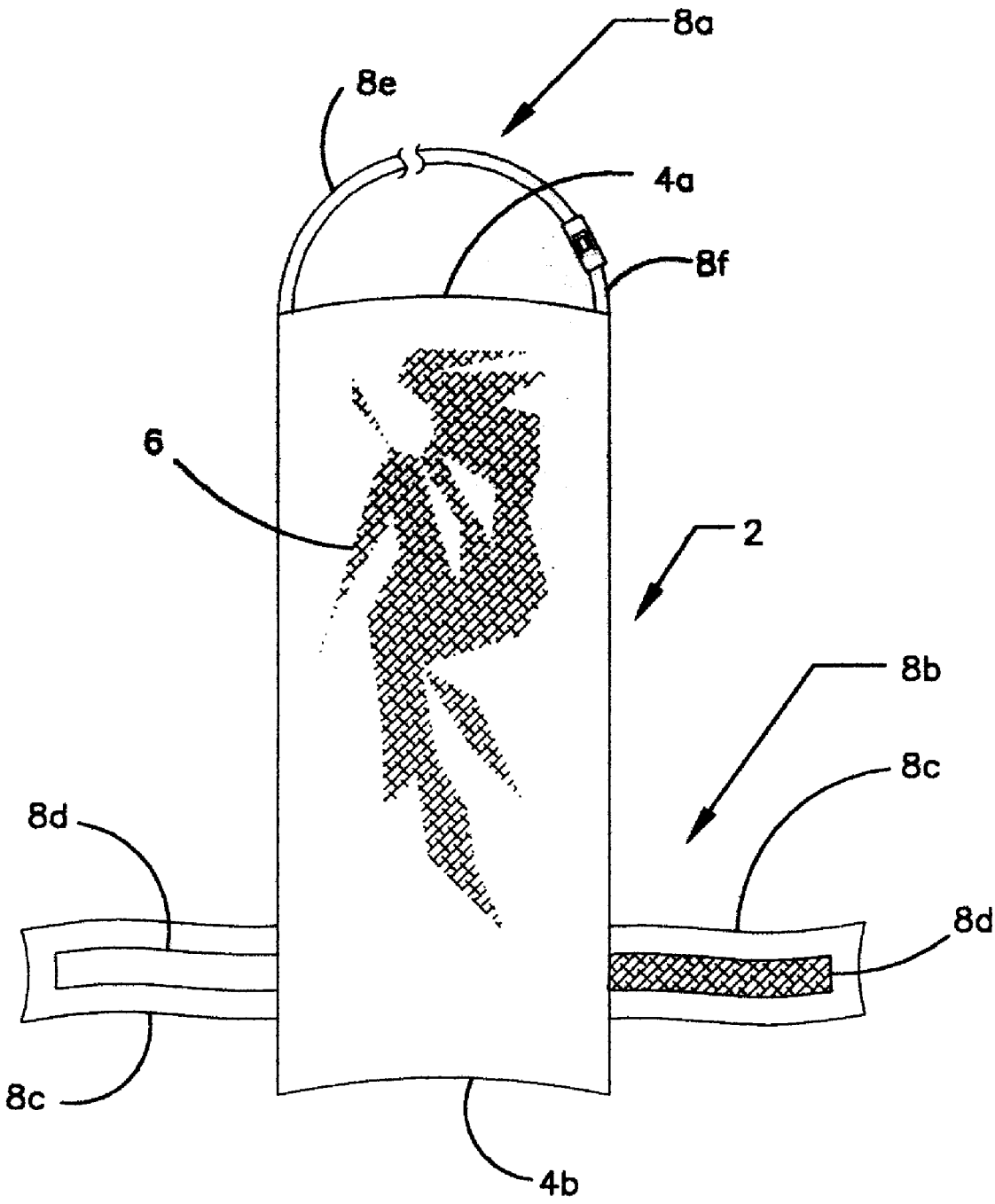
FIG. 2 is a plan view, from above, of the shoulder-pad accessory shown in FIGS. 1A and 1B.

More specifically, reference is made to FIGS. 1 and 2, in which is shown a shoulder pad accessory arm pad, made in accordance with the principles of the present invention, and generally designated by the numeral 2.

The arm pad 2 comprises an elongated padded member 4 having a foam pad 6 disposed within and attached to a peripheral elastic envelope 8. The padded member 4— has first and second open ends 4*a* and 4*b*, respectively. Attachment means 8*a* and 8*b* are provided at the first and second ends 4*a* and 4*b* of the padded member 4. The attachment means 8*a* is beneficially an elastic band 8*e* or a belt-and-buckle 8*f*. The attachment means 8*b* is beneficially an elastic band 8*e*, a hook-and-loop fastener 8*d* on an elastic band 8*c*, or a belt-and-buckle 8*f*. As seen in FIG. 1B, the foam pad 6 is thinner at the first end 4*a* than at the second end 4*b* of the padded member 4, in order not to limit range of motion of the user's arm at the shoulder. The thickness of the foam pad 6 increases continuously from the first end 4*a* to the second end 4*b* of the padded member 4. The foam pad 6 may be single-layer or may comprise a plurality of layers. The padded member 4 is sized to extend over at least a substantial portion of the wearer's arm, and to accommodate arms from six to twenty-two inches in circumference. The first end 4*a* of the padded member 4 is constructed and arranged to extend around the epaulet of a shoulder pad of a football player, and the second end 4*b* of the padded member 4 is constructed and arranged to extend around the lower portion of the player's upper arm.

Figure 3:
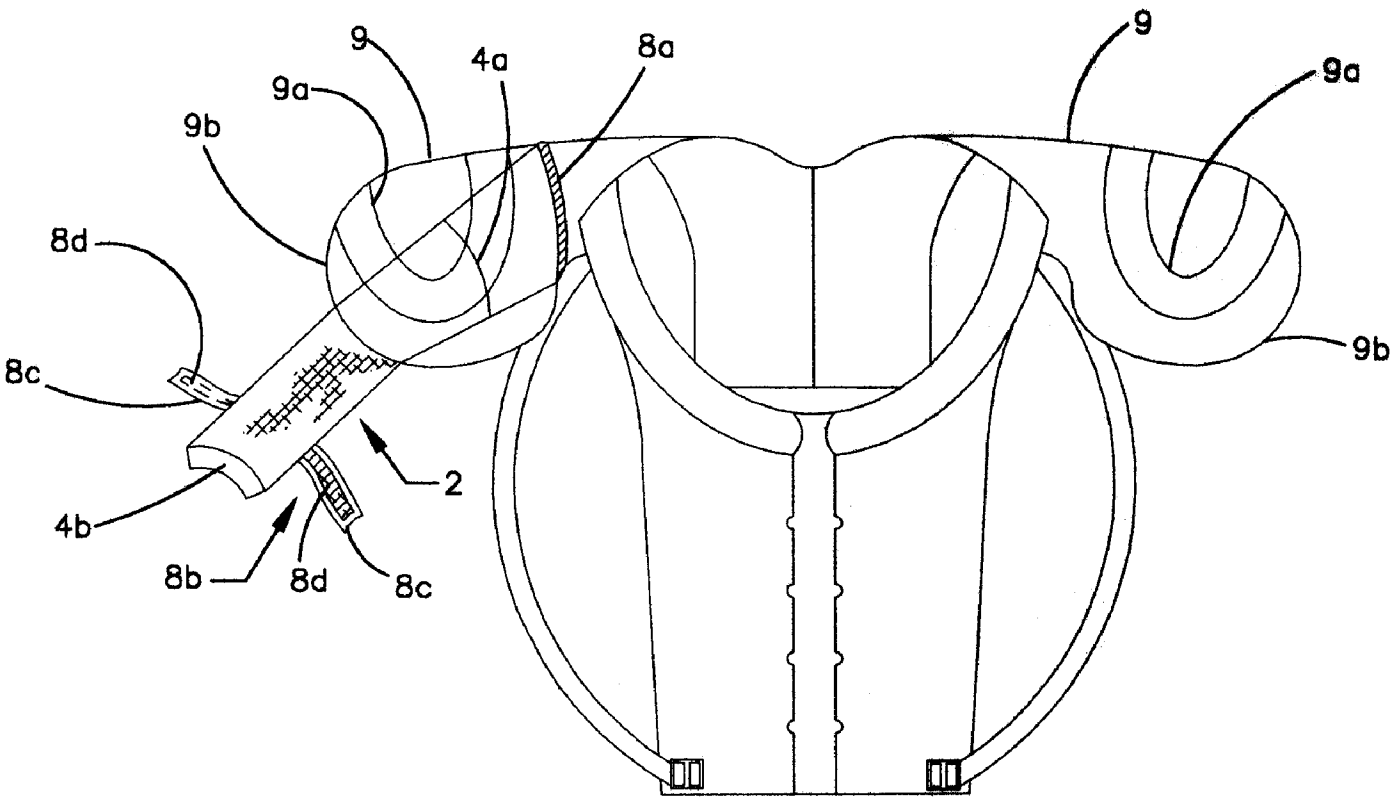
FIG. 3 is a schematic representation, from an anterior to a posterior view, showing the shoulder-pad accessory attached to a shoulder pad of a wearer.
Figure 4:
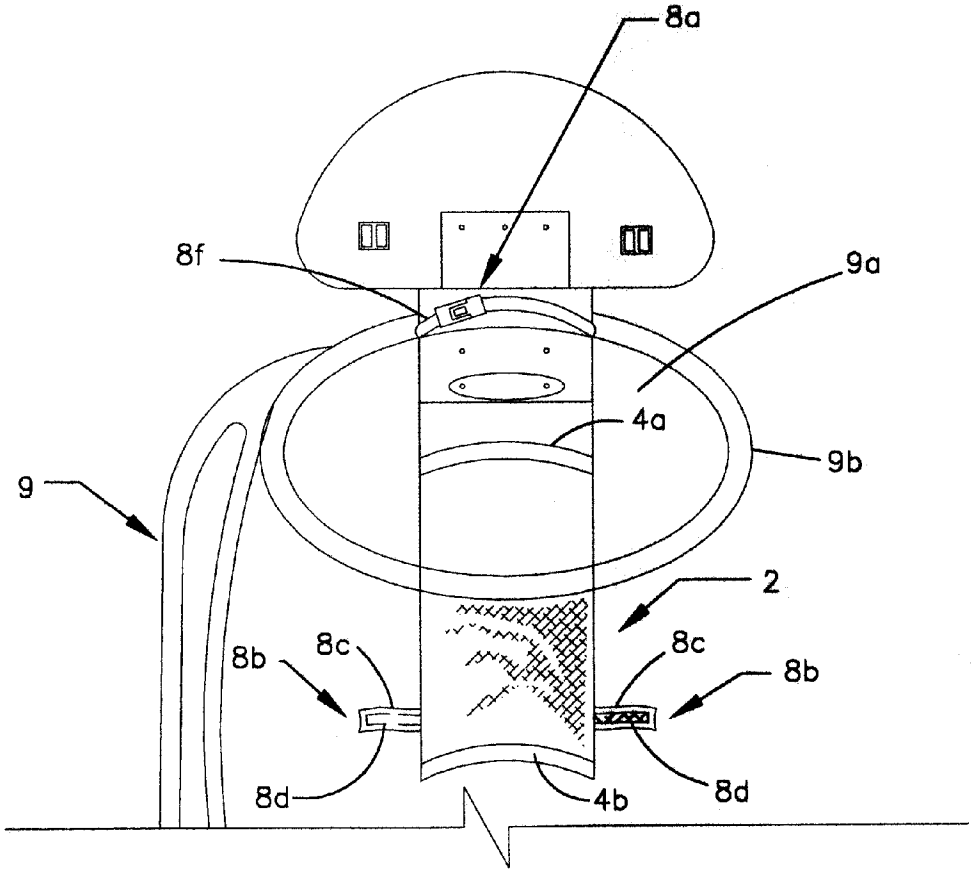
FIG. 4 is a schematic representation, viewed from one side, showing the shoulder-pad accessory attached to the shoulder pad of the wearer.

Reference is now made to FIGS. 3 and 4, in which the arm pad 2 is shown attached to a shoulder pad 9*b*. The first end 4*a* of the arm pad 2 is attached to a capulet 9*a* of the shoulder pad 9*b* of under a football jersey 9 by the attachment means 8*a*, and the second end 4*b* of the arm pad 2 is constructed and arranged for attachment to the arm of the wearer by the attachment means 8*b*. Preferably, the attachment means 8*b* comprises an elastic band 8*c* with hook-and-loop fasteners 8*d* attached thereto along the entire length of the band 8*c*, thereby enabling the arm pad 2 to accommodate arms from about six to about twenty-two inches in circumference. The arm pad 2 is preferably enclosed the envelope 8, which is beneficially an elastic tubular membrane, and the attachment means 8*a* and 8*b* may be sewn or stitched to the foam pad 6.

When fabricated and attached as described above, the arm pad 2 will remain in place and will not limit the effective range of motion of the upper arm. It will be apparent to those skilled in the art that the present invention thus provides a solution to two important problems encountered in the prior art.

While certain embodiments and details have been described to illustrate the present invention, it will be apparent to those skilled in the art that many modifications are possible without departing from the basic concept and scope of the invention.

I claim:

1. A shoulder pad accessory arm pad, comprising:

(a) an elongated padded member defining first and second opposite ends, the padded member being constructed and arranged for disposal on an arm of a wearer, to protect the arm from injury;

(b) means for attaching the first end of the padded member to a shoulder pad of the wearer; and (c) means for attaching the second end of the padded member to the arm of the wearer, to secure the padded member to the arm of the wearer;

the padded member comprising a foam pad having first and second ends, first attachment means at the first end of the padded member, for attaching the arm pad to a portion of the shoulder pad of the wearer, and second attachment means at the second end of the padded member, for attaching the arm pad to the arm of the wearer, the thickness of the foam pad increasing continuously and uniformly from the first end to the second end of the foam pad.

* * * * *